United States Patent [19]

Lamphere

[11] 4,446,622

[45] May 8, 1984

[54] TOOL FOR REMOVING STUBBORN NUTS

[75] Inventor: William R. Lamphere, Mystic, Conn.

[73] Assignee: John B. Dionne, Pawcatuck, R.I.

[21] Appl. No.: 466,092

[22] Filed: Feb. 14, 1982

[51] Int. Cl.[3] ..... B26B 27/00

[52] U.S. Cl. ..... 30/272 R; 30/124

[58] Field of Search ..... 30/123, 124, 134, 272 R, 30/360; 81/125

[56] References Cited

U.S. PATENT DOCUMENTS

| | | | |
|---|---|---|---|
| 2,558,641 | 6/1951 | Beezley | 30/272 R |
| 4,057,897 | 11/1977 | Seymour | 30/272 R |
| 4,203,211 | 5/1980 | Quick | 30/272 R |
| 4,365,413 | 12/1982 | Quick | 30/272 R |

*Primary Examiner*—Jimmy C. Peters

*Attorney, Agent, or Firm*—Albert W. Hilburger

[57] ABSTRACT

A tool for cutting and removing a nut from a threaded shank member extending beyond the nut, a particular application being to remove from the depending end portion of the shank of a faucet the nut securing the faucet to a sink. A body is formed with a pair of substantially parallel bores, one of which is threaded along its entire length for attachment to the shank. One portion of the other bore is threaded to receive a bolt, the remaining portion of the other bore is smooth walled to receive a plunger which has a chisel edge at its end nearest the nut. The bolt engages the chisel edge to drive it between an inoperative position and an operative position engaged with the nut at which point continued advancement of the bolt results in breaking and removal of the nut.

13 Claims, 15 Drawing Figures

TOOL FOR REMOVING STUBBORN NUTS

BACKGROUND OF THE INVENTION

1. Field of the Invention

This invention relates generally to tools utilized for removing stubborn nuts and, particularly, to tools utilized for the removal of nuts employed in the mounting of faucet shanks to the flange of a sink.

2. Description of the Prior Art

Most faucets which are in use today are mounted to the flange of a sink in such a manner that a base of the faucet rests upon the upper surface of the flange. A shank member typically extends downwardly through a hole preformed in the flange of the sink. The shank member is suitably connected, in a coaxial relationship, with the water supply line and, customarily, a nut is threadedly received on the shank member and bears against the under surface of the flange so as to hold the faucet firmly in place. Over a long period of time, because of the moisture which exists in the region of the sink, it is not unusual for such nuts to become corroded with rust and other chemical deposits and thereby become undesirably affixed to the shank member. Thus, when it comes time to remove the old faucet, as for replacement with a new one, the seemingly simple task often times becomes a job of major proportions.

The problem is further aggravated by reason of the fact that there is usually little room for working beneath a sink. This makes for cramped working quarters and severely restricts the range of movement available for the use of tools such as wrenches which are customarily employed in the removal of nuts. Hence, conventional tools, including wrenches, are either substantially without value or are of extremely limited benefit in the cramped working quarters beneath a sink. In some instances, hammers and chisels have been used, but their accidental misuse might result in infliction of damage to the sink basin or even in its destruction, not to mention harm to the worker.

The general problem of removal of a nut from a male threaded member, such as a screw, bolt, shank or the like has been addressed in the prior art. One typical U.S. patent is that to Beezley, No. 2,558,641, issued June 26, 1951. The Beezley patent discloses a tool for splitting metal nuts which includes an elongated body, one end of which is received over and envelopes a nut to be removed. The body extends generally within the plane of the nut and extends radially away from the nut and is provided with an internally threaded bore which is adapted to threadedly receive a screw. As the screw is advanced, it engages a plunger which, in turn, engages a chisel. Continued advancement of the chisel moves it into cutting and splitting engagement with the nut to be removed. Although the Beezley tool would seem to be a generally effective device for splitting metal nuts, a primary drawback of its construction resides in the fact that, in its operational mode, it lies in the plane of the nut to be removed. Thus, it extends a substantial distance in a radial direction away from the nut thereby limiting its use to those constructions in which there is sufficient room surrounding the nut to receive the device. In actual fact, there is generally insufficient room beneath a sink to permit the use of tools embodying the teachings of the Beezley patent.

The U.S. patent to Seymour, No. 4,057,897, issued Nov. 15, 1977, is representative of tools which have been specifically designed for the purpose of removing nuts utilized to secure a faucet onto a sink flange. As with the Beezley device, the Seymour construction includes an elongated body, or hydraulically actuated head unit, which is received over and envelops a nut to be removed. A curved moveable jaw is recessed into the unit, opposite which, and also recessed, is a piston operated cutting blade. Enough room is provided between the cutting blade and the jaw for the nut to fit snuggly. A high pressure flexible hydraulic line connects a distant hand powered hydraulic pump to the head unit. Pressure from the pump drives the piston toward the cutting blade, cutting the nut and permitting its removal.

While the Seymour device, also, could be effective in removing a corroded nut, it has a number of drawbacks. These reside in its complex and expensive construction, and, as with the Beezley device, the fact that the head unit, in its operational mode, lies in the plane of the nut to be removed and extends for a substantial distance in a radial direction away from the nut.

Still another device designed specifically for removing nuts from faucet shanks is disclosed in the U.S. patent to Quick, No. 4,203,211 issued May 20, 1980. The Quick patent discloses an elongated sleeve which surrounds and threadedly engages the depending end portion of a faucet shank having a nut securing it to a sink. A thrust bearing, having a bore loosely surrounding the faucet shank, is secured to the end of the sleeve, adjacent to a faucet nut to be removed, and is provided with radially disposed cutting blades projecting toward the faucet nut. The cutting blades, which are permanently exposed, regardless of whether the device is in the operative or inoperative mode, are moved into splitting engagement with the faucet nut by manual angular rotation of the sleeve relative to the faucet shank.

While the Quick device, also, as with its predecessors, Beezley and Seymour, could be an effective device in the removal of a stubborn nut, it, too, exhibits serious drawbacks. These drawbacks reside in its complex and expensive construction, particularly its numerous threaded portions, its spring, and its thrust bearing. Furthermore, the cutting blades are exposed at all times such that they are subject to harm when not in use, or require a separate cover for their protection. Additionally, the large number of moving parts would likely result in future maintenance of the device with resultant down time.

Each of these patents are generally representative of the prior art and, although they were deemed to be advances in the state of the art at the time they were conceived and reduced to practice, the drawbacks which have been mentioned are deemed noteworthy.

SUMMARY OF THE INVENTION

It was with recognition of the need and of the state of the prior art that the present invention was conceived and reduced to practice. To this end, the present invention discloses a tool for cutting and removing a nut from a threaded shank member extending beyond the nut, a particular application being to remove from a depending end portion of the shank of a faucet, the nut securing the faucet to the flange of a sink. A body is formed with a pair of substantially parallel bores, one of which is threaded along its entire length for attachment to the shank member. One portion of the other bore may be threaded to receive a bolt, the remaining portion of the other bore being smooth walled to receive a plunger which has a chisel edge at its end nearest the nut. The bolt engages the chisel edge to drive it between an inoperative position and an operative position engaged with the nut at which stage of the operation, continued advancement of the bolt results in breaking and removal of the nut.

The present invention, as disclosed, is lightweight, portable, readily usable, and can be applied, in a substantially universal manner, to a variety of sink and faucet constructions. The invention is particularly advantageous where working quarters are cramped, such as in the region beneath a sink. The invention employs existing and inexpensive materials, and is of simplified construction. Because the tool of the invention has a minimum number of parts, the invention has excellent wearability and calls for minimum maintenance. The only other tool required for the operation of the invention is a conventional allen wrench which is necessary to rotate the bolt.

The basic design of the invention may be modified in a number of ways and still come within the scope of the invention. For example, it has been found to be preferable that the second bore which receives the plunger might be angularly disposed relative to the first bore which is received on the shank. This renders the chisel head even more effective in removing the nut. In another embodiment, it might be desirable for a pointed element to engage and sever the nut. Such a construction can eliminate still another element, reducing the number of critically necessary parts for operation of the invention to two. For those constructions employing a chisel edge for engaging the nut to be removed, various instrumentalities can be utilized to prevent relative rotation between the chisel edge and the nut as the former is advanced toward the nut. Additionally, in those applications employing a chisel edge, it has been found desirable to utilize a captive screw construction whereby the bolt and the plunger formed with a chisel edge at one end thereof, are unitary. That is, they advance and retract as a unit while yet allowing the bolt to rotate independently of the plunger.

Other and further features, objects, advantages, and benefits of the invention will become apparent from the following description taken in conjunction with the following drawings. It is to be understood that both the foregoing general description and the following detailed description are exemplary and explanatory, but are not restrictive of the invention. The accompanying drawings, which are incorporated in and constitute a part of the invention, illustrate several embodiments of the invention, and together with the description, serve to explain the principles of the invention.

DESCRIPTION OF THE PREFERRED EMBODIMENTS

Figure 1:
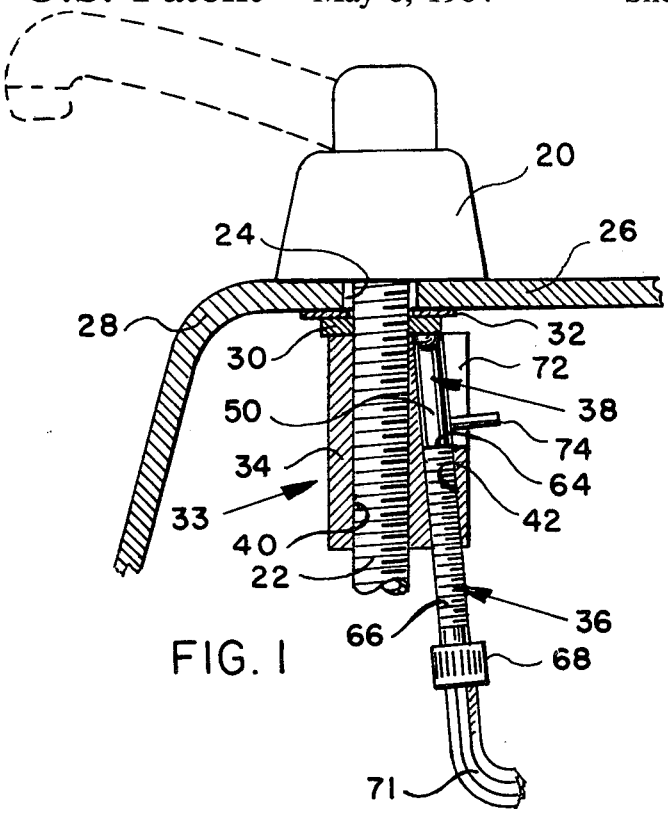
FIG. 1 is a detail side elevation view of a sink and associated faucet, certain portions being cut away and in section, illustrating the invention being applied thereto and in the operative position.

Refer now to the drawings and initially to FIG. 1 which is generally illustrative of the invention in use. As previously explained, the invention can be used generally for the removal of a nut which has become seized on a screw, bolt, shank, or similar threaded male element, one specific application of the invention being the removal of such a seized nut from a shank securing a faucet to the flange of a sink. FIG. 1 is generally illustrative of the latter application for the invention.

Thus, a water faucet 20 is generally equipped with a downwardly extending threaded shank member 22 which extends through an opening 24 formed in a flange 26 of a sink or basin 28. It is customary for a nut 30 to be threadedly received on the shank member 22 and, in conjunction with a washer 32, be tightened to the point that the faucet 20 is held firmly in place on the flange 26.

In accordance with the invention, then, a tool for cutting and removing a nut from a threaded shank member extending beyond the nut comprises a body adapted to be removably attached to the shank member adjacent to the nut to be removed; and severing means having a longitudinal axis substantially parallel with the shank member when said body is attached to the shank member, said severing means being supported on said body and including a fracturing element movable between retracted and advanced positions such that when said body is attached to the shank member adjacent to the nut, said fracturing element in the retracted position is distant from the nut and in the advanced position is sufficiently engaged with the nut to sever the same.

As embodied herein, with continuing reference to FIG. 1, a tool 33 generally incorporates the principles of the invention. It includes a body 34 which is illustrated as being removably attached to the shank member 22 adjacent to the nut 30 to be removed. The tool 33 also includes severing means generally indicated at 36 having a longitudinal axis substantially parallel with the shank member 22 when the body 34 is attached to the shank. The severing means is supported on the body 34 and includes a fracturing element generally indicated at 38 movable between a retracted position (see FIG. 2) and an advanced position (see FIG. 1) such that when the body 34 is attached to the shank member 22 adjacent to the nut 30, the fracturing element, in the retracted position, is distant from the nut and, in the advanced position, is sufficiently engaged with the nut to sever it.

In accordance with the invention, a tool for cutting and removing a nut from a threaded shank member extending beyond the nut comprising a body having a first threaded bore adapted to be threadedly received on the shank member in abutting relationship with the nut, said body having a second bore, at least partially threaded, with a longitudinal axis substantially parallel to the longitudinal axis of the first threaded bore; and severing means including a fracturing element threadedly received within the second bore movable between a first position whereat said element is distant from the nut and fully retracted within said body and a second position whereat said element is engaged with the nut such that continued movement of said element into further engagement with the nut results in severing of the nut by said element.

Figure 2:
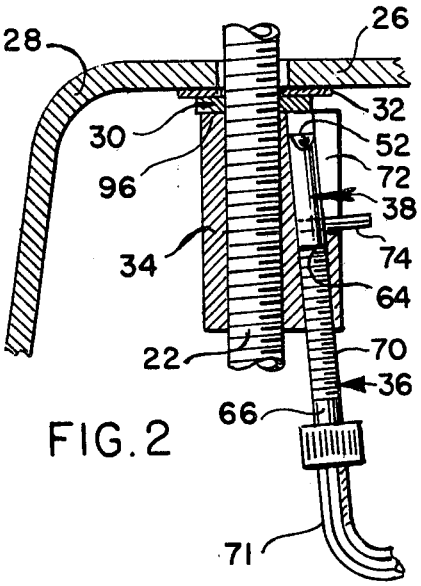
FIG. 2 is a side elevation view, in cross section, similar to FIG. 1 illustrating the invention in its inoperative position.

As embodied herein, and with continuing reference to FIGS. 1 and 2, it is seen that the body 34 is formed with a first threaded bore 40 enabling the body to be threadedly received on the shank member 22 in abutting relationship with the nut 30. The body 34 is also suitably formed with a second bore 42 which is at least partially threaded and having a longitudinal axis substantially parallel to the longitudinal axis to the first threaded bore 40. As previously described, the severing means 36 includes a fracturing element 38. The severing means 36 is threadedly received within the second bore 42 and, upon rotation, is movable between a first position (see FIG. 2) in which the fracturing element 38 is distant from the nut 30 and fully retracted within the body 34, and a second position in which the fracturing element 38 is engaged with the nut 30 such that continued movement of the element into still further engagement with the nut results in severing of the nut by the element.

Figure 3:
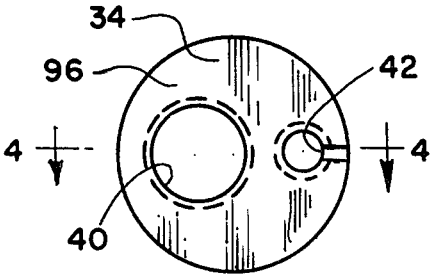
FIG. 3 is a top plan view of one part of the invention.
Figure 5:
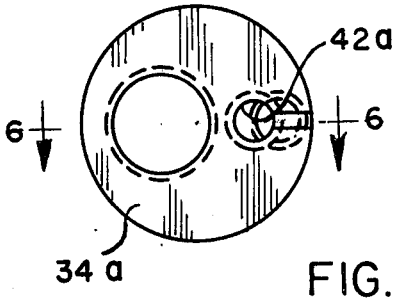
FIG. 5 is a top plan view of a modified form of the part illustrated in FIG. 3.
Figure 4:
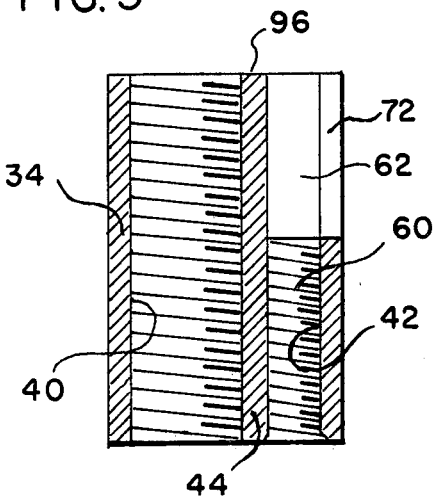
FIG. 4 is a cross section view generally taken along line 4—4 in FIG. 3.
Figure 6:
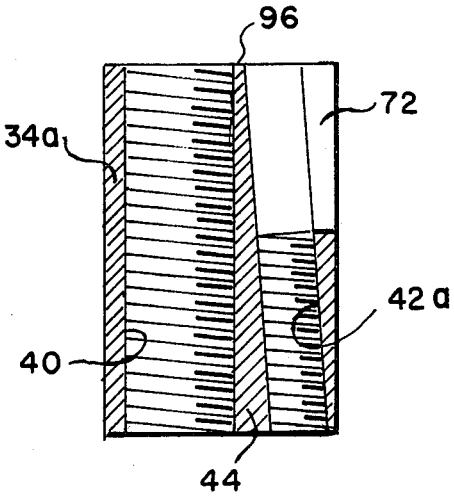
FIG. 6 is a cross section view generally taken along line 6—6 in FIG. 5.

In accordance with the invention, the tool is generally as previously described wherein the longitudinal axes of the first and second bores intersect and subtend an angle between them in the range of greater than 0° to less than 5°. As embodied herein, with particular reference now to FIGS. 3 and 4, it has been found that the construction of the body 34 in which the longitudinal axes of the bores 40 and 42 are substantially parallel is acceptable in use and enables the invention to perform its intended function. Nevertheless, it has been found desirable in actual practice to provide a second bore **42*a* (see FIGS. 5 and 6) in such a manner that its longitudinal axis intersects the longitudinal axis of the first bore 40 and such that the axes subtend an angle between them in a range between 0° and 5°. In this manner, the fracturing element 38 is able to fully engage the nut 30 and yet sufficient structure is retained at the lower end of the body 34 as at 44 (see FIG. 4) so as to assure the structure soundness of the body in the region between the bores 40 and 42*a***.

Figure 7:
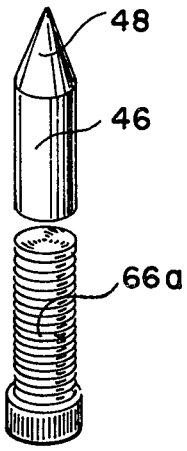

In accordance with the invention, the tool is generally as previously described wherein said fracturing element is a plunger slidably received in the second bore including a pointed end engageable with the nut. As embodied herein, with particular reference now to FIG. 7, one embodiment of the fracturing element is indicated as being in the form of a plunger 46 slidably received in the second bore 42 and including a pointed end 48 engageable with the nut.

In accordance with the invention, the tool is generally as previously described wherein said fracturing element is a plunger slidably received in the second bore including a chisel edge engageable with the nut. As embodied herein, with particular reference now to FIG. 8, another embodiment of the invention is seen wherein the fracturing element is a plunger 50 slidably received in the second bore 42 and including a chisel edge 52 engageable with the nut 30.

Figure 9:
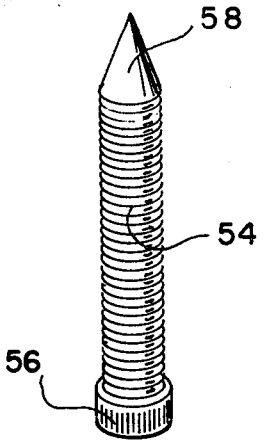
FIGS. 7, 8, and 9 are perspective views of different embodiments of another part of the invention.

In accordance with the invention, the tool is generally as previously described wherein the second bore is threaded for its entire length and wherein said fracturing element is a bolt member threadedly engageable with the second bore and having a driving end and a driven end, said driven end being pointed and engageable with the nut. As embodied herein, and with particular reference now to FIG. 9, yet another embodiment of the invention is disclosed wherein the entire length of the second bore 42 is threaded to receive a bolt member 54 having a driving end 56 and a driven end 58, the latter end being pointed and engageable with the nut 30.

In accordance with the invention, the tool is generally as previously described wherein said severing means includes constraint means cooperating with said body to substantially prevent angular rotation between said plunger and said body. As embodied herein, various forms of such constraint means are illustrated most clearly in FIGS. 10 and 12–15. These specific embodiments will be described below.

In accordance with the invention, the tool is generally as previously described wherein said body has a first threaded bore adapted for threaded reception on the shank member; and wherein said body has a second cylindrical bore, one portion of the second bore being threaded and the remaining portion of the second bore being smooth walled; and wherein said severing means includes a smooth walled cylindrical plunger slidably received within the smooth walled portion of the second bore, said plunger including a fracturing element at one end engageable with the nut and a blunt surface at the other end thereof, constraint means cooperating with said body to substantially prevent angular rotation between said plunger and said body, and a bolt member threadedly engageable with the threaded portion of the second bore and having a driving end and a driven end, said driven end engageable with said blunt surface of said plunger such that said fracturing element is retracted and advanced according to movement of said bolt member.

Figure 8:
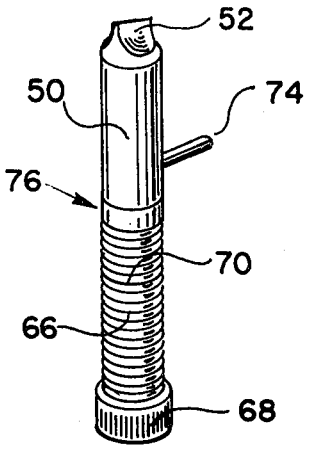

As embodied herein, with continuing reference especially to FIGS. 1, 2, and 8, has been previously described that the body 34 has a first cylindrical threaded bore 40 adapted for threaded reception of the shank member 22. Furthermore, the body 34 has a second cylindrical bore 42, one portion of the second bore being threaded as indicated at 60 in FIG. 3, the upper, or remaining, portion 62 of the bore 42 being smooth walled. In keeping with the smooth walled construction of the upper portion 42, the severing means 36 is seen to include (FIGS. 1 and 2) a smooth walled cylindrical plunger 50 (see also FIG. 8) which is slidably received therewithin. As previously described with respect to the structure illustrated in FIG. 7, the plunger may include a fracturing element in the form of a pointed end 48 or it may be in the form of a chisel edge 52 (see FIG. 8), but in either instance, is engageable with the nut 30. The plunger 50 is provided with a blunt surface 64 (see FIGS. 1 and 2) at its end opposite the chisel edge 52. As previously explained, constraint means are provided which cooperate with the body 34 to substantially prevent angular rotation between the plunger 50 and the body 34. Specific embodiments of such constraint means will be described below. The severing means 36 also includes a bolt member 66 which is threadedly engageable with the threaded portion 60 of the second bore 42. Furthermore, the bolt member 66 has a driving end or head 68 and an opposite, or driven, end 70 (FIG. 8) engageable with the blunt surface 64 of the plunger 50 such that the fracturing element or chisel edge 52 is retracted and advanced according to movement of the bolt member 66. With respect to the construction illustrated in FIG. 7, it will be appreciated that the numeral 66*a* is utilized to designate a bolt member employed in association with the plunger 46.

In accordance with the invention, the tool is generally as previously described and includes means selectively engageable with said bolt member to effect angular rotation thereof. As embodied herein, with particular reference to FIGS. 1 and 2, it is seen that the driving end or head 68 of the bolt member 66 is of the allen head type such that a conventional allen wrench 71 can be employed to turn the bolt member and thereby advance the plunger 50 and its chisel edge 52. Of course, it will be understood that although an allen head bolt member and cooperating wrench have been disclosed for operation of the invention, the specific type of head and associated tool may be of any suitable design, the particular type not being critical to the invention.

Figure 10:
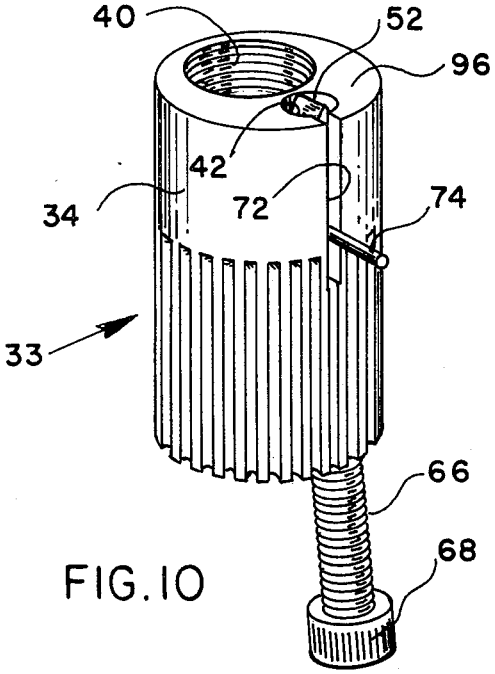
FIG. 10 is a perspective view of an embodiment of the invention illustrated in FIGS. 1 and 2.

In accordance with the invention, the tool is generally as previously described wherein said body has a longitudinal slot and wherein said constraint means includes a pin fixed to said plunger and extending transversely thereof and engageable with the slot as said plunger is retracted and advanced in the second bore. As embodied herein, with particular reference now to FIG. 10, wherein the body 34 is illustrated incorporating one embodiment of a constraint means to substantially prevent angular rotation between a plunger, such as 50, and the body. In the embodiment illustrated in FIG. 10, the body 34 is formed with a longitudinal slot 72 in its outer wall and communicating with the second bore 42. The slot 72 is generally coextensive with the upper or smooth walled portion 62 of the bore 42. As seen in FIGS. 1, 2, and 10, a pin 74 is fixed to the plunger 50 and extends transversely of the plunger and is engageable with the slot 72 and moves along the slot as the plunger is retracted and advanced in the bore 42. The interaction of the pin with the slot is such as to prevent angular rotation of the plunger within the bore.

Figure 11:
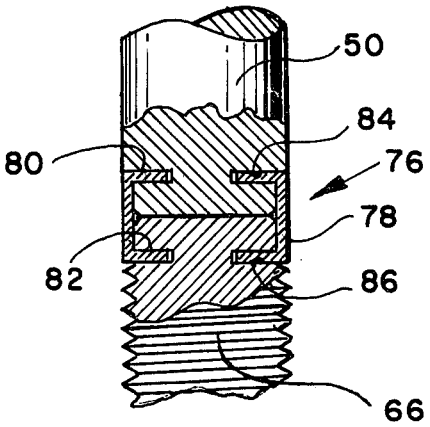
FIG. 11 is a detail side elevation view, certain parts being cut away and in section, of parts illustrated in FIG. 8.

In accordance with the invention, the tool is generally as previously described including coupling means joining said plunger and said bolt member together such that they move axially through the second bore as a unit and such that angular rotation of said bolt member does not cause angular rotation of said plunger. As embodied herein and with particular reference now to FIGS. 8 and 11, coupling means 76 are provided in order to assure that the chisel edge 52 does not rotate in an angular manner about a longitudinal axis of the plunger 50 as the plunger is advanced or retracted by means of the bolt member 66. At the same time, it is desirable for the plunger 50 and the bolt member 66 to be joined so that they move as a unit through the bore 42. One typical construction, as illustrated in FIG. 11, includes a clip member 78 with upper and lower flanges 80 and 82, respectively, which engage angular grooves 84 and 86 which are formed, respectively, adjacent the lower end of the plunger 50 and adjacent the driven end 70 of the bolt member 66. The clip member 78 is split vertically so that it can, in spring-like fashion, be received around the outer surfaces of the plunger and bolt member, then snap into place within the grooves 84 and 86. This loose engagement allows the bolt member 66 to rotate relative to the plunger 50 but the flanges 80 and 82, engaged as they are with the grooves 84 and 86, assure that the bolt member 66 and the plunger 50 will travel longitudinally through the bore 42 as a unit.

In accordance with the invention, the tool is generally as previously described wherein said body has a first threaded bore and adapted for threaded reception on the shank member; and wherein said body has a second bore, one portion of the second bore being threaded and the remaining portion having a polygonal cross section, and wherein said severing means includes a plunger having a polygonal cross section similar to the cross section of the remaining portion of the bore and slidably received therein, said plunger including a chisel edge at one end engageable with the nut and a blunt surface at the other end thereof, and a bolt member threadedly engageable with the threaded portion of the second bore, and having a driving end and a driven end, said driven end engageable with said blunt surface of said plunger such that said chisel edge is retracted and advanced according to movement of said bolt.

Figure 12:
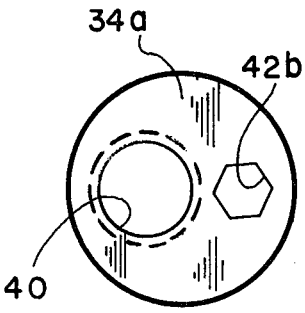
FIG. 12 is a top plan view, similar to FIGS. 3 and 5 of a modified part of the invention.
Figure 13:
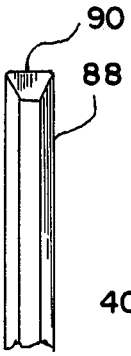
FIG. 13 is a side elevation of another modified part which cooperates with the part illustrated in FIG. 12.

As embodied herein, and referring now to FIGS. 12 and 13, a modified embodiment of the invention is disclosed in which a body 34*a* is suitably formed with a second bore 42*b*, one portion of the second bore being threaded and the remaining portion having a polygonal cross section. Likewise, the severing means includes a plunger 88 having a polygonal cross section similar to the cross section of the remaining portion of the bore 42*b*. Although the modified cross section is illustrated as being hexagonal, it is within the scope of the invention for the cross section to have any number of sides, as desired. The only restriction is that the size and shape of the plunger 88 must conform to the size and shape of the remaining portion of the bore 42*b*. Of course, the construction as described is for the purpose of preventing angular rotation between the plunger 88 and the bore 42*b* so as to assure that the chisel edge will always maintain its orientation with respect to the nut 30 regardless of the position of the plunger 88 along the length of the bore 42*b*.

In accordance with the invention, the tool is generally as previously described wherein said body has a first threaded bore adapted for threaded reception on the shank member; and wherein said body has a second bore, one portion of the second bore being threaded and the remaining portion having an elliptical cross section, and wherein said severing means includes a plunger having an elliptical cross section similar to the cross section of the remaining portion of the second bore and slidably received therein, said plunger including a chisel edge at one end engageable with the nut and a blunt surface at the other end thereof, and a bolt member threadedly engageable with the threaded portion of the second bore, and having a driving end and a driven end, said driven end engageable with said blunt surface of said plunger such that said chisel edge is retracted and advanced according to movement of said bolt member.

Figure 14:
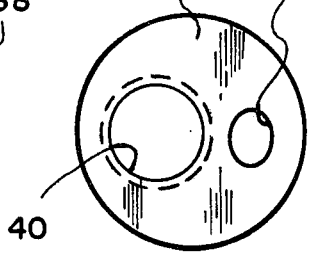
FIG. 14 is a top plan view, similar to FIGS. 3 and 5 to still another modified part of the invention.
Figure 15:
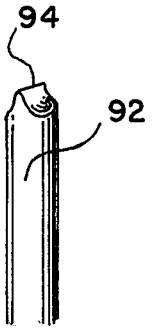
FIG. 15 is a side elevation of yet another modified part which cooperates with the part illustrated in FIG. 12.

An embodied herein, with particular reference now to FIGS. 14 and 15, another embodiment of the invention utilizes a modified body 34*b* which is suitably formed with a second bore 42*c*, one portion of which is threaded and the remaining portion is of an elliptical cross section. Similarly, the severing means includes a plunger 92 having an elliptical cross section similar to the cross section of the remaining portion of the bore 42c and slidably received therein. As with previous embodiments, the plunger 92 includes a chisel edge 94 adapted for engagement with the nut to be severed. As with the embodiment of FIGS. 12 and 13, the embodiment of FIGS. 14 and 15 serves to prevent angular movement of the chisel edge 94 with respect to the nut as the plunger 92 is moved longitudinally through the bore 42c.

OPERATION

The operation of the invention is generally as follows, consisting of three easy steps. At the outset, it is necessary to shut off the water to the water faucet 20 and disconnect the supply pipe. Next, the tool 33 is turned clockwise onto the supply shank member 22 until a forward surface 96 of the body 34 rests against the nut 30. The bolt member 66 is then tightened with an ordinary allen wrench forcing the plunger 50 and its chisel edge 52 toward, and eventually into, the nut 30 causing the nut to split. After the nut is split in one location, it might be necessary of desirable to turn the tool one half a revolution and repeat the preceding procedure, splitting the nut again. The pieces comprising the nut 30 will then fall from the shank member 22 making ready the faucet 20 for removal.

Thus has been described a simple, effective, and time saving tool which enables the ready removal of faucets and any other devices which might be difficult to remove by reason of a stubborn nut.

The invention, in its broader aspects, is not limited to the specific details as shown and described; rather, departures may be made from such details without departing from the principles of the invention and without sacrificing its chief advantages.

What I claim is:

1. A tool for cutting and removing a nut from a threaded shank member extending beyond the nut comprising:

a body having a first threaded bore adapted to be threadedly received on the shank member in abutting relationship with the nut, said body having a second bore, at least partially threaded, with a longitudinal axis substantially parallel to the longitudinal axis of the first threaded bore; and severing means including a fracturing element threadedly received within the second bore movable between a first position whereat said element is distant from the nut and fully retracted within said body and a second position whereat said element is engaged with the nut such that continued movement of said element into further engagement with the nut results in severing of the nut by said element.

2. A tool as set forth in claim 1 wherein the longitudinal axes of the first and second bores intersect and subtend an angle between them in the range of greater than 0° to less than 5°.

3. A tool as set forth in claim 1 wherein said fracturing element is a plunger slidably received in the second bore including a pointed end engageable with the nut.

4. A tool as set forth in claim 1 wherein said fracturing element is a plunger slidably received in the second bore including a chisel edge engageable with the nut.

5. A tool as set forth in claim 1 wherein the second bore is threaded for its entire length and wherein said fracturing element is a bolt member threadedly engageable with the second bore and having a driving end and a driven end, said driven end being pointed and engageable with the nut.

6. A tool as set forth in claim 4 wherein said severing means includes constraint means cooperating with said body to substantially prevent angular rotation between said plunger and said body.

7. A tool as set forth in claim 1 wherein said body has a first threaded bore adapted for threaded reception on the shank member; and wherein said body has a second cylindrical bore, one portion of the second bore being threaded and the remaining portion of the second bore being smooth walled; and wherein said severing means includes a smooth walled cylindrical plunger slidably received within the smooth walled portion of the second bore, said plunger including a fracturing element at one end engageable with the nut and a blunt surface at the other end thereof, constraint means cooperating with said body to substantially prevent angular rotation between said plunger and said body, and a bolt member threadedly engageable with the threaded portion of the second bore and having a driving end and a driven end, said driven end engageable with said blunt surface of said plunger such that said fracturing element is retracted and advanced according to movement of said bolt member.

8. A tool as set forth in claim 5 including means selectively engageable with said bolt member to effect angular rotation thereof.

9. A tool as set forth in claim 7 wherein said body has a longitudinal slot and wherein said constraint means includes a pin fixed to said plunger and extending transversely thereof and engageable with the slot as said plunger is retracted and advanced in the second bore.

10. A tool as set forth in claim 7 including coupling means joining said plunger and said bolt member together such that they move axially through the second bore as a unit and such that angular rotation of said bolt member does not cause angular rotation of said plunger.

11. A tool as set forth in claim 1 wherein said body has a first threaded bore adapted for threaded reception on the shank member; and wherein said body has a second bore, one portion of the second bore being threaded and the remaining portion having a polygonal cross section, and wherein said severing means includes a plunger having a polygonal cross section similar to the cross section of the remaining portion of the bore and slidably received therein, said plunger including a chisel edge at one end engageable with the nut and a blunt surface at the other end thereof, and a bolt member threadedly engageable with the threaded portion of the second bore, and having a driving end and a driven end, said driven end engageable with said blunt surface of said plunger such that said chisel edge is retracted and advanced according to movement of said bolt.

12. A tool as set forth in claim 11 including coupling means joining said plunger and said bolt member together such that they move axially through the second bore as a unit and such that angular rotation of said bolt member does not cause angular rotation of said plunger.

13. A tool as set forth in claim 1 wherein said body has a first threaded bore adapted for threaded reception on the shank member; and wherein said body has a second bore, one portion of the second bore being threaded and the remaining portion having an elliptical cross section, and wherein said severing means includes a plunger having an elliptical cross section similar to the cross section of the remaining portion of the second bore and slidably received therein, said plunger including a chisel edge at one end engageable with the nut and a blunt surface at the other end thereof, and a bolt member threadedly engageable with the threaded portion of the second bore, and having a driving end and a driven end, said driven end engageable with said blunt surface of said plunger such that said chisel edge is retracted and advanced according to movement of said bolt member.

* * * * *